United States Patent [19]

Niece

[11] 4,019,768

[45] Apr. 26, 1977

[54] DEVICE FOR SANITARY PICKUP OF GROUND DEPOSITED EXCREMENT

[75] Inventor: Melvin L. Niece, Lakeview, Ohio

[73] Assignee: NBS Incorporated, Huntsville, Ohio

[22] Filed: Nov. 5, 1975

[21] Appl. No.: 629,615

[52] U.S. Cl. ..... 294/19 R; 294/55; 294/1 R; 15/257.7

[51] Int. Cl.[2] ..... A47F 13/06

[58] Field of Search ..... 294/1 R, 19 R, 24, 51, 294/52, 55, 19 A; 119/1 R; 15/257.7, 257.9; 248/99, 100; 229/53, 62; 224/26 R, 26 G, 26 K

[56] References Cited

UNITED STATES PATENTS

| | | | |
|---|---|---|---|
| 2,522,243 | 9/1950 | Wieland | 294/33 |
| 2,972,851 | 2/1961 | Goehring | 294/19 A |
| 3,703,158 | 11/1972 | Lemier | 119/1 R |
| 3,757,737 | 9/1973 | Drum et al. | 294/55 |
| 3,767,247 | 10/1973 | Wetzler | 294/1 R |
| 3,786,780 | 1/1974 | Pezzino | 294/1 R |
| 3,810,670 | 5/1974 | Turi | 294/19 R |

*Primary Examiner*—James B. Marbert
*Attorney, Agent, or Firm*—Clarence A. O'Brien; Harvey B. Jacobson

[57] ABSTRACT

A device for sanitary pickup of ground deposited excrement comprises a metal frame structure having an excrement engaging pickup portion and a conventional bag supporting portion. Said bag holding portion positively retains a conventional shopping bag on the holding portion in a manner to hold the mouth of the bag open for ready reception of the said excrement together with additional structure supported by the handle for quick and easy release of said bag from positive retention on the support portion. Additional covers are also provided for the excrement engaging portion of the device to increase the usefulness of said device.

8 Claims, 7 Drawing Figures

10
26
2
27
24
22
25
12
30
13
22
28
33
2
34
11
34
27
26
24
25
22

20
30
13
28
14
15
3
3
18
14
35
32
34

DEVICE FOR SANITARY PICKUP OF GROUND DEPOSITED EXCREMENT

BACKGROUND OF THE INVENTION

1. Field of the Invention

This invention relates to an improved excrement pickup device, said device having an excrement engaging portion, and a conventional bag holding portion so arranged as to hold the mouth of the bag open for ready reception of the excrement therein together with positive retention means for the bag which is quickly releasable.

2. Description of Prior Art

A common problem with previous devices for picking up excrement and other undesirable substances is that the use of the device normally still has to touch some portion of the device which has come into contact with the excrement, and/or physcially touch portions of the bag or container in which the excrement ends up.

Another problem with known prior art devices is that special bags and containers are necessary for proper use of said devices which increase the expense of using same as well as making said devices more inconvenient. Many times special bags and containers are not readily available "at any price" and therefore renders the overall device inoperative.

Another problem of known prior art devices is that they are not provided with adaptable structure for picking up excrement or grass or turf-type surfaces as well as solid pavements, floors, patios, etc.

Prior art devices which are known to the applicant which may be pertinent to this invention are: Soergel, U.S. Pat. No. 3,711,141 and Anderson, U.S. Pat. No. 3,754,785; these patents cover devices intended primarily for holding lawn and leaf type bags open for filling during lawn cleanup operations. They are not directed toward pickup and disposal of animal excrement as is the device of this invention. A patent to Bredt, U.S. Pat. No. 3,819,220 and a patent to Johnson, U.S. Pat. No. 3,052,214 also are known; these devices are not intended for use in gathering excrement off ground or pavement, but are for the purpose of catching or receiving the excrement as it is being dropped. Also these devices require special bags or receptacles for proper use thereof. The Fisher U.S. Pat. No. 3,281,178 and the Prescott Pat. No. 3,830,423 are both directed to devices intended for pickup of excrement from the ground, but they both require special bags and/or containers for use of same. None of the known prior art devices offer the simple, inexpensive, easy-to-use and operate, excrement pickup structure as disclosed by this invention.

SUMMARY OF THE INVENTION

An object of the present invention is to provide an excrement pickup device which is easy and simple to use, and yet completely sanitary.

Another object of this invention is to provide an excrement pickup device usable with conventional type bags which are easily slipped onto the support portion of the device and just as easily released therefrom by simply squeezing the handle.

A further object of the invention is to provide a conventional bag supporting structure having a single retention hook as part of the structure so that the bag will be positively retained thereon while excrement is being picked up and the bag is being filled, and yet allowing easy, sanitary release for disposal of said bag.

A sitll further object of this invention is to provide a sanitary excrement pickup device having flexibility in that the device may be used either on ground and turf, or just as satisfactorily be used on solid pavements and floors.

A still further additional object of this invention it to provide an excrement pick up device which is more sanitary in operation as well as being simpler in operation than previous devices of the type.

These together with other objects and advantages which will become subsequently apparent reside in the details of construction and operation as more fully herinafter described and claimed, reference being had to the accompanying drawings forming a part hereof, wherein like numerals refer to like parts throughout.

DESCRIPTION OF PREFERRED EMBODIMENT

Figure 1:
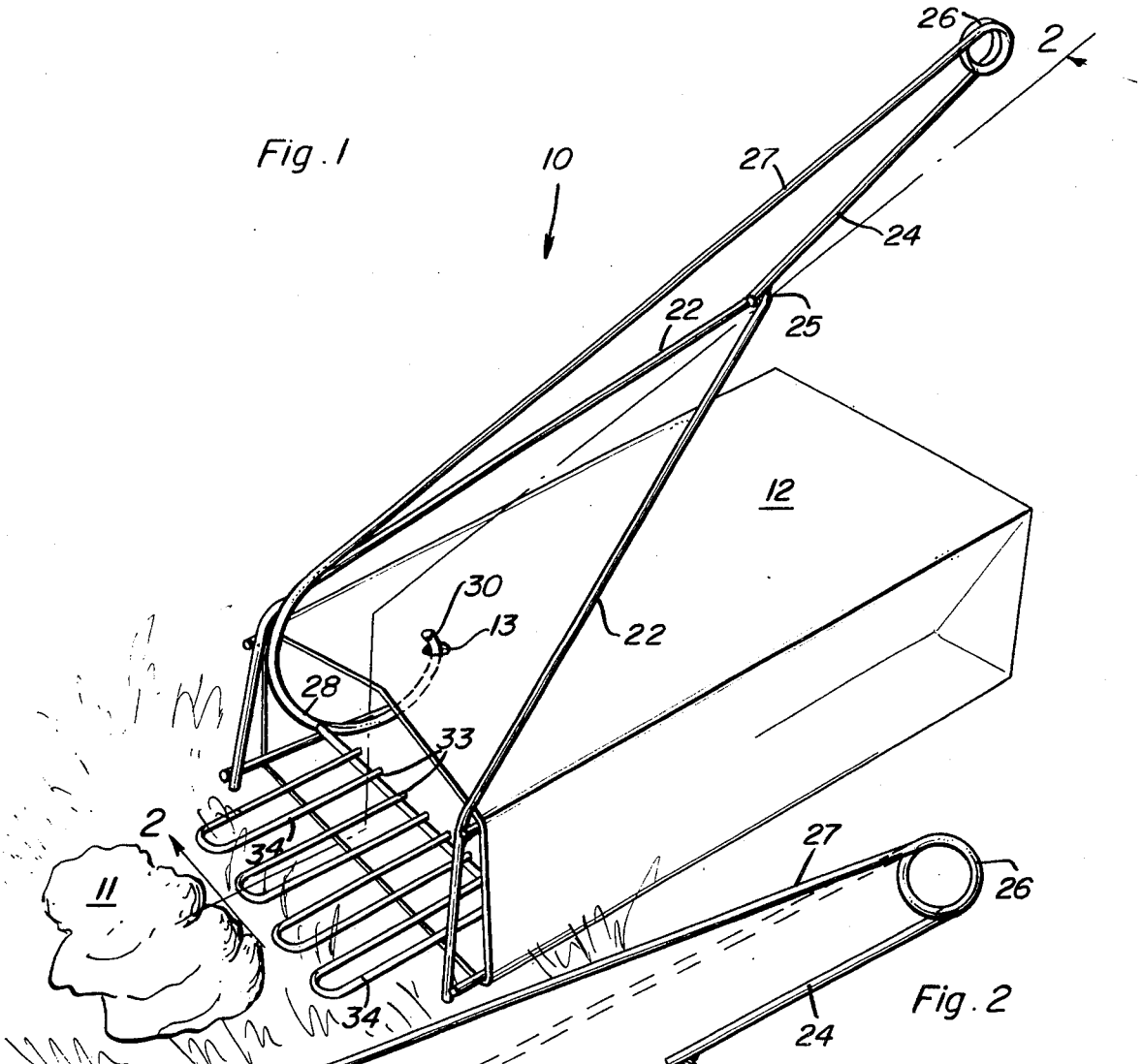
FIG. 1 is a perspective view of the device of this invention in use.

FIG. 1 shows the preferred embodiment of this invention indicated is general by reference numeral 10. One of the features of this device is that it is usable with conventional readily attainable shopping bags indicated by reference numeral 12. For proper use of these bags a hole 13 must be provided along one upper side thereof, but said hole is easily punched into any regular bag without requiring special bags. However the manufacturer and distributor of the excrement pickup device of this invention may, if desired, provide and sell bags with holes 13 already provided therein.

Figure 2:
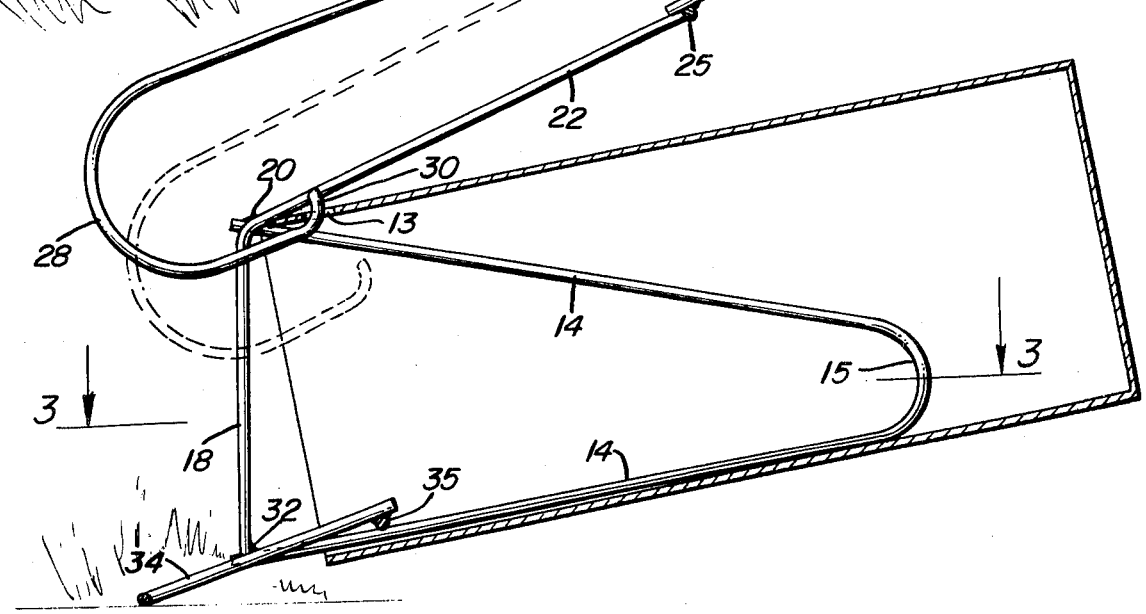
FIG. 2 is a side elevational view of the device in use, partly in cross section.
Figure 4:
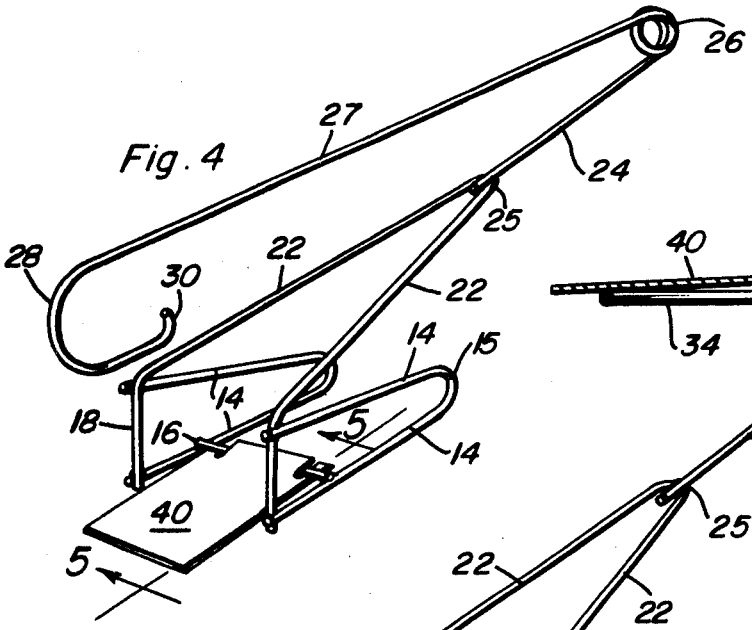
FIG. 4 is a perspective view of a modified form of the present invention.

Looking at FIG. 2 the main features of this device may be seen. A bag supporting frame comprising two identical side portions indicated by reference numeral 14 are connected by a bend 15 at one end and attached to member 18 by welding or other fastening means 20, 32 at the other ends thereof. The upright rods 18 complete the side bag holding portion of the device and continue onto handle portion 22 as best seen in FIGS. 1 and 4. The rest of the handle includes member 24 which is a heavy wire or rod of metal similar to the rods already described. A spring-like convolution 26 is provided at one end of the rod 24 with one end of this handle being welded at 25 to the members 22 to complete the lower handle structure of the device. The other portion of the handle 27 extends to the front of the pickup device where it continues in a curved portion 28 in a U shape back under to a hook portion 30. This unique flexible handle and retention structure is part of the new and novel features of this invention. As can be seen in FIG. 2, because of the spring action of coil 26, the hook 30 will normally retain the bag 12 on the bag support sides 14 by passing through hole 13 in said bag. This will positively retain the bag on the holder and yet permit quick and easy release of said bag when the bag is to be disposed of. The dash lines of FIG. 2 indicate the release condition of said handle/-holder structure.

Figure 3:
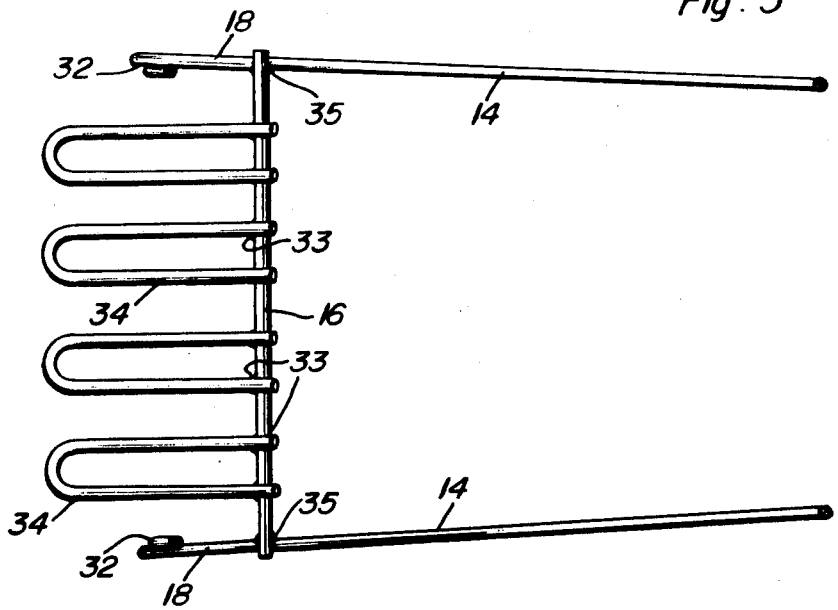
FIG. 3 is a sectional view taken generally along line 3—3 of FIG. 2.

Further important structure of this device consists of the excrement pickup portion best seen in FIGS. 1 and 3. A rod 16 is welded between the side rods 14 at 35 and excrement engaging members 34 are suitably welded to rod 16 at points 33. These excrement engaging members or prongs 34 readily pick up excrement from lawn or grass surfaces.

In operation, looking at FIG. 1, the excrement 11 shown in a clump of grass on a lawn is readily engageable by the prongs 34 therebeneath and the user of the device lifts the over-all device with the excrement resting on the top of prongs 34 and tilts the device so said excrement falls into the bag 12. Since the bag is positively retained on the holder by means of the hole 13 and hook 30 a number of pickups may be made without fear of the bag slipping off. After the bag is filled to the desired capacity it is then easily deposited in a trash pickup or other disposal container by merely holding the complete device over the container and squeezing the handle members 24, 27 together to disengage hook 30 from hole 13 and gravity force will cause the bag to drop into the disposal container. Thus the operator can pick up excrement without ever coming close to same and it is not necessary at any time to directly contact the bag. The prong members are the only portion of the over-all device that come into actual contact with the excrement and they may be readily cleaned underneath the normal outside faucet or by use of a garden hose. The rod material for the device would be of metal having some spring-like flexibility and preferably of the rustproof type.

Another embodiment of this invention is shown in FIG. 4, wherein the basic structure of the pickup device and holder is the same as that described above, and corresponding reference numerals are used. The additional feature is the number 40 which is preferably made of metal or plastic or other flexible yet rigid material. The member 40 has clips formed at two corners thereof as indicated by reference numerals 42, 44. This flat plate 40 is installed on the device on top of the tines 34 and forced rearwardly so that the offset formed in the clips hook under the horizontal bar 16 on which the tines are attached, thereby securing the plate for use as a scoop on hard surfaces. Thus as can be readily visualized the addition of this member to the previously described device makes the over-all structure readily usable for any type surface. In other words, attach the flat plate 40 for use on pavement, sidewalk, floor or other hard surface or detach the plate and use the tines for pickup of excrement from grass or turf surfaces.

Figure 6:
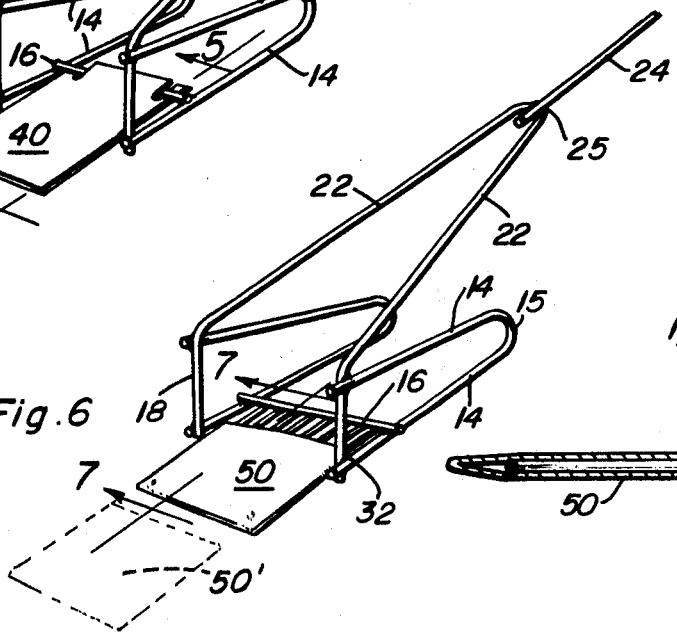
FIG. 6 is a perspective view of another modified form of the present invention.
Figure 7:
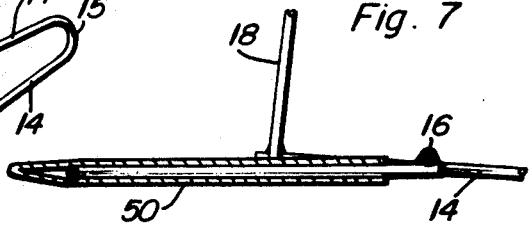
FIG. 7 is a cross-sectional view, in part, of the device of FIG. 6 taken generally along line 7—7 of said figure.

A further embodiment of this invention is shown in FIGS. 6 and 7 wherein an envelope 50 made of thin, rigid, waxed or oiled cardboard designed to fit snugly over the tines is provided. Te envelope is of the proper size to fit over the tines 34 with a slightly snug fit, thereby being retained thereon by said friction fit. With the envelope slipped over the tines as shown in FIGS. 6 and 7 the over-all device can be used as a scoop on hard surfaces and then after using, the envelope can be disposed of and a new one attached for the next use. An additional advantage of using the envelope modification is that it virtually eliminates the need for cleaning the device after use, since very little, if any, of the excrement comes in contact with the frame of the device.

Figure 5:
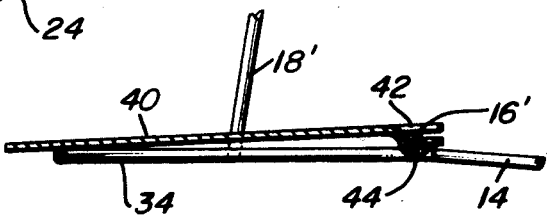
FIG. 5 is a cross-sectional view of part of the device of FIG. 4 taken generally along line 5—5 of said figure.

Another variation of this embodiment is to use a envelope 50′ made of plastic material similar to the envelope described in the preceding paragraph. However, the plastic envelope would not necessarily be disposable, but could be used similar to the metal or plastic plate 40 described with FIGS. 4 and 5.

The present invention affords simple, economic means for collecting pet excreta easily and effectively without soiling the person or the individual using te device, uses readily obtainable conventional bags, said bags being readily disposable, and the need for cleaning the over-all device is practically eliminated.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device for sanitary pickup of ground deposited excrement comprising; a frame structure for supporting a conventional type bag in an open position thereon, a handle attached to said frame structure, hook means associated with said handle to positively yet releasably retain the open bag on said frame and also to positively release the bag, and further means attached to said frame for contacting excrement to be picked up, the means associated with the handle to positively yet releasably retain the open bag includes two rod portions connected by a convolute spring portion at on end of said rod portions and the other end of one of the rod portions having a bag engaging hook thereon, the convolute spring permitting a releasing action of the bag by the hook when the rod portions are squeezed together by a user of the device.

2. The device as defined in claim 1 wherein the further means for contacting excrement includes at least two prongs attached at the front of the frame, said prongs each being formed of wire rod having two longitudinally extending main portions connected at the outer end by a continuous curve portion so that ground deposited excrement on turf and grass can be readily contacted and lifted by said prongs.

3. A device for sanitary pickup of ground deposited excrement comprising; a frame structure for supporting a coventional type bag in an open position thereon, a handle attached to said frame structure, means associated with said handle to positively yet releasably retain the open bag on said frame, and further means attached to said frame for contacting excrement to be picked up, the means associated with the handle includes two rod portions connected by a convolute spring portion at one end of said rod portions and the other end of one of the rod portions having a bag engaging hook thereon, the further means for contacting excrement includes at least two prongs attached at the front of the frame, said prongs each being formed of wire rod having two longitudinally extending main portions connected at the outer end by a continuous curve portion so that ground deposited excrement on turf and grass can be readily contacted and lifted by said prongs, together with a rectangular plate member positioned over the excrement engaging prongs so that the device may be used on flat surface such as concrete and macadam.

4. The device as defined in claim 3 wherein the plate member is of semi-rigid material and is provided with spring clips at two of the corners thereof for removably attaching the said plate to the frame structure of the device.

5. A device for sanitary pickup of ground deposited excrement comprising; a frame structure for supporting a conventional type bag in an open position thereon, a handle attached to said frame structure, means associated with said handle to positively yet releasably retain the open bag on said frame, and further means attached to said frame for contacting excrement to be picked up, the means associated with the handle includes two rod portions connected by a convolute spring portion at one end of said rod portions and the other end of one of the rod portions having a bag engaging hook thereon, the further means for contacting excrement includes at least two prongs attached at the front of the frame, said prongs each being formed of wire rod having two longitudinally extending main portions connected at the outer end by a continuous curve portion so that ground deposited excrement on turf and grass can be readily contacted and lifted by said prongs, together with an envelope fitted over and frictionally engaged with the said prong members for the purpose of preventing their direct contact with the excrement to be picked up.

6. The device as defined in claim 5 wherein the said envelope is made of plastic material for easy cleaning thereof and as a non-disposable part of the over-all device.

7. The devide as defined in claim 5 wherein said envelope is made of waterproof cardboard material so that said envelope may be discarded after use thereof.

8. A device for sanitary pickup of ground deposited excrement comprising; a structure made of wire rod having two side portions basically of triangular shape for removably holding a conventional type bag in the open position thereon, said side portions connected together with additional frame structure rods welded thereto, excrement engaging prongs attached to said connecting structure and disposed outwardly away from the opening in said bag so that once said prongs are placed beneath excrement, the device may be lifted and turned so that the excrement is deposited in the bag, handle structure formed of the same wire rod materials and welded to the side portion members, and additional handle and bag retaining means attached to said handle structure for positively retaining the open bag on the bag holding frame structure and yet permitting quick and easy positive actuate release thereof for bag disposal purposes without touching the bag with the hands, and the additional handle and bag retaining means including a first rod welded to the primary handle structure at one end thereof, a spring coil at the other end of said rod, and a further rod connected at one end to said spring coil and provided with a bag engaging hook portion at the other end thereof for positively yet releasably retaining an open bag supported by said frame structure.

* * * * *